US007867052B2

(12) United States Patent
Hayama et al.

(10) Patent No.: US 7,867,052 B2
(45) Date of Patent: Jan. 11, 2011

(54) METHOD OF MANUFACTURING SUPPORT MEMBER

(75) Inventors: Akira Hayama, Sagamihara (JP); Junichi Kimiya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 12/429,344

(22) Filed: Apr. 24, 2009

(65) Prior Publication Data

US 2009/0280712 A1 Nov. 12, 2009

(30) Foreign Application Priority Data

May 12, 2008 (JP) ..... 2008-124555

(51) Int. Cl.
*H01J 9/00* (2006.01)
*H01J 17/49* (2006.01)

(52) U.S. Cl. ..... 445/24; 313/495

(58) Field of Classification Search ..... 313/495–497; 445/24–25

See application file for complete search history.

(56) References Cited

U.S. PATENT DOCUMENTS

| | | | | |
|---|---|---|---|---|
| 6,222,313 | B1 * | 4/2001 | Smith et al. | 313/495 |
| 6,617,772 | B1 * | 9/2003 | Barton et al. | 313/292 |
| 2005/0275335 | A1 | 12/2005 | Hayama et al. | 313/495 |
| 2007/0200481 | A1 | 8/2007 | Hayama | 313/495 |
| 2008/0084160 | A1 | 4/2008 | Hayama | 313/505 |
| 2009/0072695 | A1 | 3/2009 | Hiroike et al. | 313/292 |

FOREIGN PATENT DOCUMENTS

JP 8-7811 A 1/1996

* cited by examiner

*Primary Examiner*—Anne M Hines
(74) *Attorney, Agent, or Firm*—Fitzpatrick, Cella, Harper & Scinto

(57) ABSTRACT

A method of high precisely manufacturing, for an electron beam displaying apparatus, a support member which is equipped with an electrode on the surface thereof is provided. In this method, an electrode region is formed on the surface of a base material, the surface of the base material is ground by using a grinding stone having a convex portion, and at the same time a fringe portion of the electrode region is ground to form an electrode.

2 Claims, 4 Drawing Sheets

METHOD OF MANUFACTURING SUPPORT MEMBER

BACKGROUND OF THE INVENTION

1. Field of the Invention

The present invention relates to a method of manufacturing a support member which acts as an atmospheric pressure resistant member of an electron beam displaying apparatus.

2. Description of the Related Art

A flat panel electron beam displaying apparatus using an electron-emitting device such as a surface conduction electron-emitting device or the like has been proposed as an image displaying apparatus capable of achieving reduced weight and reduced thickness. In the image displaying apparatus like this, a vacuum container is formed by oppositely arranging a rear plate having an electron-emitting device and a face plate having a light emitting member of emitting light in response to irradiation of electrons, and sealing the arranged rear and face plates via a frame member located on the fringe of the arranged plates. Besides, a support member called a spacer is provided between oppositely arranged substrates (i.e., the rear and face plates) so as to prevent transformation and damage of the substrate due to a difference of air pressure between the inside and the outside of the vacuum container.

Here, Japanese Patent Application Laid-Open No. H08-007811 discloses a constitution in which an electrode is provided on a support member as a means for preventing the support member from being electrified by collision of electrons emitted from an electron-emitting device.

With respect to the support member disclosed in Japanese Patent Application Laid-Open No. H08-007811, it is desired to improve uniformity of a potential distribution formed on the surface of the support member. To achieve this, it is necessary to high precisely form the electrode on the surface of the support member.

SUMMARY OF THE INVENTION

The present invention aims to provide a method of high precisely manufacturing a support member which is equipped with an electrode on the surface thereof.

The present invention is characterized by providing a method of manufacturing a support member to be used in an electron beam displaying apparatus in which an electron source for emitting electrons and an electron-irradiated member to which the electrons emitted from the electron source are irradiated are oppositely arranged via the support member, the method comprising: forming, on a surface of a base material, an electrode region of which resistance is lower than that of the base material; and forming, with use of a grinding stone having a convex portion, a concave portion on the surface of the base material by grinding a portion on the surface of the base material where the electrode region has been formed, and an electrode by grinding a part of the electrode region.

The present invention further comprises, as a preferred embodiment, transforming the base material by heat-drawing, in a longitudinal direction of the electrode, the base material on which the concave portion and the electrode have been formed.

According to the present invention, it is possible to high precisely manufacture the support member which is equipped with the electrode on the surface thereof. Therefore, in the electron beam displaying apparatus in which the support member according to the present invention is used, it is possible to prevent deviation of trajectory of electrons emitted from an electron-emitting device, and it is thus possible to perform high-quality image displaying.

Further features of the present invention will become apparent from the following description of the exemplary embodiments with reference to the attached drawings.

DESCRIPTION OF THE EMBODIMENTS

An electron beam displaying apparatus, in which a support member of the present invention is used, includes an FED (Field Emission Display) displaying apparatus and a displaying apparatus having surface conduction electron-emitting devices (SED). In these electron beam displaying apparatuses, since the support member is arranged between a rear plate on which electron-emitting devices are provided and a face plate on which a light emitter (for example, a phosphor) is provided, this case is a preferable form to which the support member according to the present invention is applied.

Figure 1:
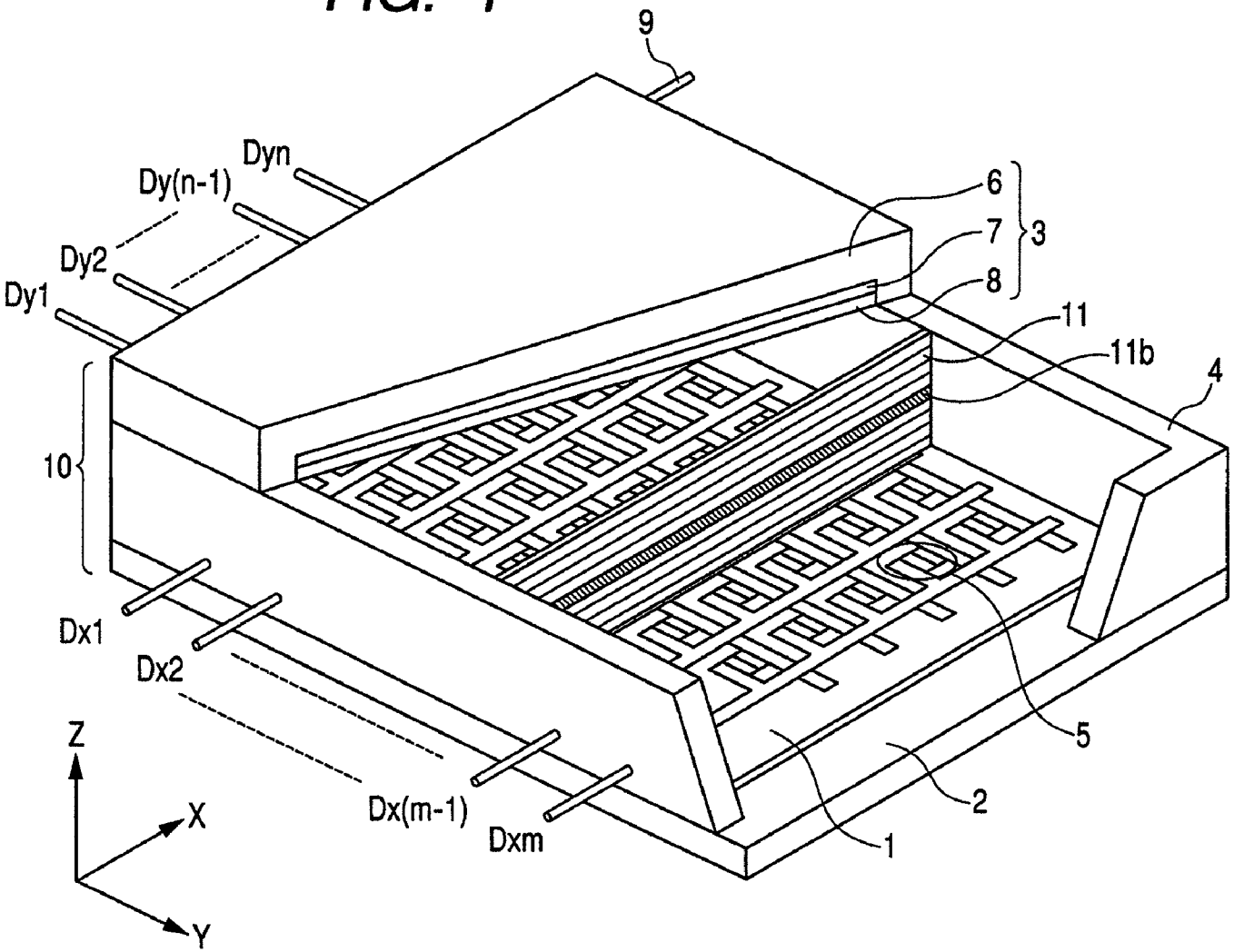
FIG. 1 is a respective view illustrating the constitution of one example of a displaying apparatus which used a support member according to the present invention.

FIG. 1 illustrates the constitution of one example of the electron beam displaying apparatus. In FIG. 1, a rear plate 2, to which an electron source substrate 1 is fixed, and a face plate 3 composed of a glass substrate 6, of which an inner surface is formed with a fluorescent film 7 serving as a light emitting member and a metal back 8 serving as an anode, are illustrated.

The rear plate 2 and the face plate 3 are fixed to a support frame 4 through a frit glass or the like to form an envelope 10. Since the rear plate 2 is provided for the purpose of mainly reinforcing the intensity of the electron source substrate 1, in a case that the electron source substrate 1 itself has the sufficient intensity, the rear plate 2 can be omitted. Plural electron-emitting devices 5 are arranged on the electron source substrate 1 to be wired in a passive matrix form by X-directional wirings Dx1 to Dxm and Y-directional wirings Dy1 to Dyn.

As the electron-emitting devices 5, cold cathode devices such as a surface conduction type, an FE (Field Emission) type or an MIM (Metal-Insulation-Metal) type are used. An electron beam from the above-mentioned electron source to be formed on the rear plate 2 is accelerated by the desired acceleration voltage, which is supplied to the face plate 3, and irradiated to the face plate 3. At this time, the phosphor emits light by a fact that electrons collide with the fluorescent film 7 formed on the face plate 3 to create the constitution that an image is produced on the face plate 3.

The constitution having the sufficient intensity for the atmospheric pressure is provided by setting up a support member 11 called a spacer between the face plate 3 and the rear plate 2. In this case, in upper and lower portions of the support member 11, that is, in a joint surface with the electron source and a joint surface with an electron beam-irradiated member (the fluorescent film 7 or the metal back 8), a low-resistance film (an edge-face electrode which not illustrated) used for surely supplying the potential on a surface of the support member 11 is provided. Then, a potential distribution is formed on a surface of the support member 11 by a fact that the potential to be supplied to the rear plate 2 and the face plate 3 is applied to upper and lower edges of the support member 11.

This potential distribution is formed by concave portions formed on an exposed surface of the support member 11 standing between the electron source and the electron beam-irradiated member and an electrode 11*b* extensionally existing in an X-directional place (refer to FIG. 1) put between the concave portions. And, this potential distribution plays a role of guiding an electron beam emitted from the electron source, which exists in the vicinity of the support member 11, to a desired place on the face plate 3.

First Embodiment

Figure 2:
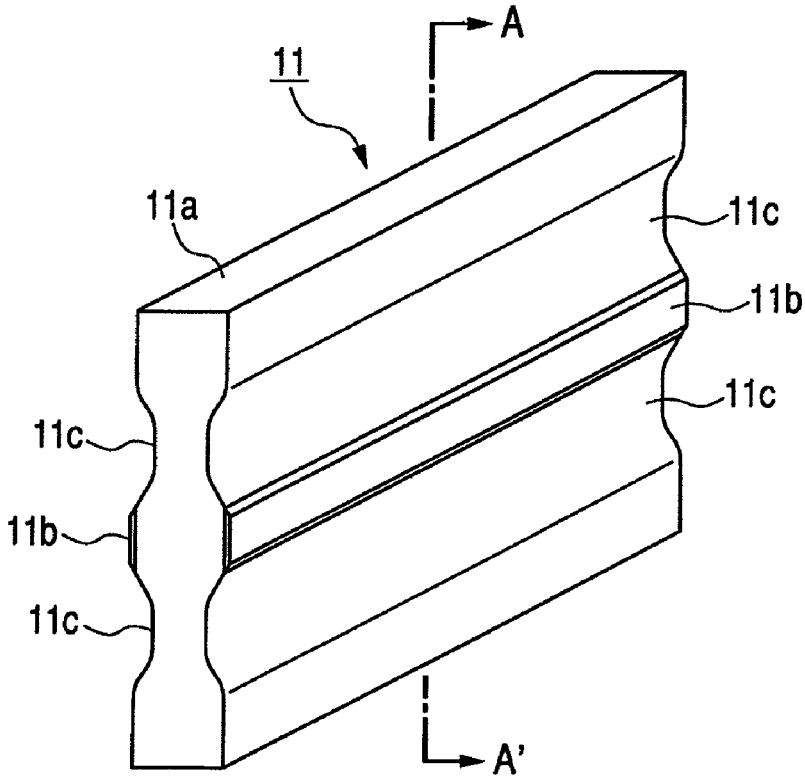
FIG. 2 is a perspective view of one example of the support member according to the present invention.

A perspective view of an example of the support member 11 according to the present invention will be illustrated in FIG. 2.

The support member 11 according to the present invention has the electrode 11*b* and concave portions 11*c* on a surface of a base material 11*a* as exemplified in FIG. 2. In the present embodiment, the base material 11*a* has a shape of a long flat plate where the electrode 11*b* and the concave portions 11*c* are provided in parallel in a longitudinal direction to be used by arranging the longitudinal direction in parallel to the X-direction.

Figure 3A:
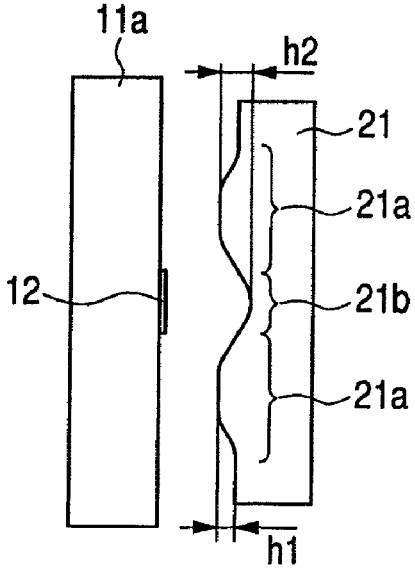
FIGS. 3A and 3B are cross-sectional schematic views illustrating a manufacturing process of the support member illustrated in FIG. 2.
Figure 3B:
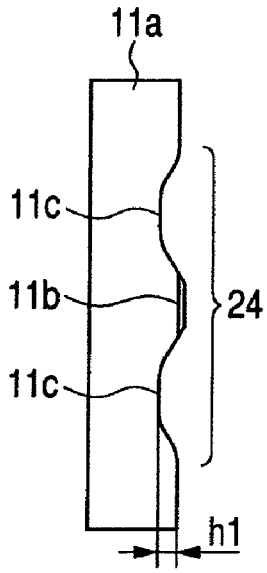

FIGS. 3A and 3B are schematic views illustrating a manufacturing process of the support member 11 illustrated in FIG. 2 and correspond to a cross-sectional surface A-A' in FIG. 2.

Usually, an insulating member is used for the base material 11*a*. In particular, a silica glass, a glass of decreasing a contained amount of impurity such as Na or the like, a soda lime glass and a ceramics member such as an alumina or the like are enumerated. In case of executing a heat-drawing process in the second embodiment to be described later, a glass is used. It is also possible to give electro-conductivity to these members arbitrarily. In addition, it is preferable that a coefficient of thermal expansion of the base material 11*a* approximates to that of the members of forming the rear plate 2 and the face plate 3.

An electrode region 12 is formed on a surface of the base material 11*a*. The electrode region 12, which is such a region of which the resistance is lower than that of the base material 11*a*, can be preferably formed by arranging an electro-conductive thin film by a photolithography method, however can be formed by dispersing metal micro-particles in the base material. In particular, metals such as Ni, Cr, Au, Mo, W, Pt, Ti, Al, Cu and Pd or alloys of these metals and print conductors constituted from metals or a metal oxide such as Pd, Ag, Au, $RuO_2$ and Pd—Ag and the glass can be enumerated. In addition, a transparent conductor such as an $In_2O_3$—$SnO_2$ or the like and a semiconductor material such as a polysilicon or the like are also used.

A surface of the base material 11*a*, on which the electrode region 12 was formed, is ground by using a grinding stone 21 having convex portions 21*a* and a concave portion 21*b* (FIG. 3A). When a surface of the base material 11*a* is ground by the grinding stone 21, although concave portions 11*c* are formed on a surface of the base material 11*a*, a marginal part of the electrode region 12 is also ground by the convex portions 21*a* of the grinding stone 21 at the same time. However, since a depth h2 of the concave portion 21*b* adjacent to the convex portions 21*a* of the grinding stone 21 is set to become deeper than a depth h1 of the concave portions to be formed on the base material 11*a*, a part of the electrode region 12 is remained without being ground and the electrode 11*b* is formed (FIG. 3B).

After grinding the base material 11*a* by the grinding stone 21 in this manner, the concave portions 11*c* and the electrode 11*b* are formed in a transfer region 24 of the convex portions 21*a* and the concave portion 21*b* of the grinding stone 21. At this time, the electrode 11*b* is uniformly ground in a whole area of the X-direction by the grinding stone 21, and since an electrode width is determined by only a difference between height of the convex portions 21*a* and depth of the concave portion 21*b* of the grinding stone 21, the electrode 11*b* can be formed with a uniform position and a uniform width in a whole area of an axial direction.

A boundary portion (edge portion) with the concave portions 11*c* of the electrode 11*b* can be uniformly formed with a sharp form as compared with an electrode formed by the conventional photolithography method or printing method. Therefore, accuracy of a position and a form of an electrode edge portion becomes a high level.

In case of providing the electrodes 11*b* and the concave portions 11*c* on both surfaces of the support member 11 as in FIG. 2, after providing the electrode 11*b* and the concave portions 11*c* on the one surface, it is only necessary to execute the same process on the other surface.

As for the support member 11 according to the present invention, the potential distribution formed along the Z-direction toward the face plate 3 from the rear plate 2 is uniformly formed for any X-directional positions and variations can be reduced as compared with a support member having an electrode according to the conventional manufacturing method. As a result, variations of electron beam irradiation positions which have been generated by the potential distribution in the X-direction on a surface of the support member 11 can be suppressed, and the electron beam in the vicinity of the support member 11 is formed on the face plate 3 as a uniform line of not having variations, and a high-quality image display can be realized.

In the above-mentioned embodiment, although the electrode 11*b* to be formed on a surface of the support member 11 has been described as one example, it is not limited to this case. And, the potential distribution on a surface of the support member 11 can be more uniformly formed along the X-direction by increasing the number of electrodes to become two, three or more.

Figure 4:
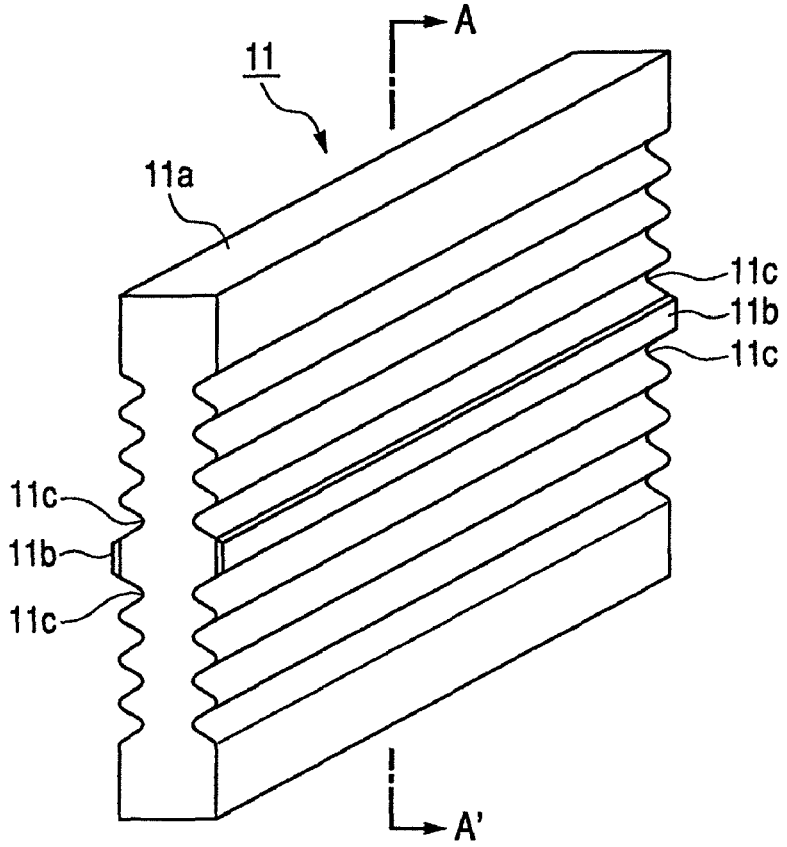
FIG. 4 is a perspective view of another example of the support member according to the present invention.
Figure 5A:
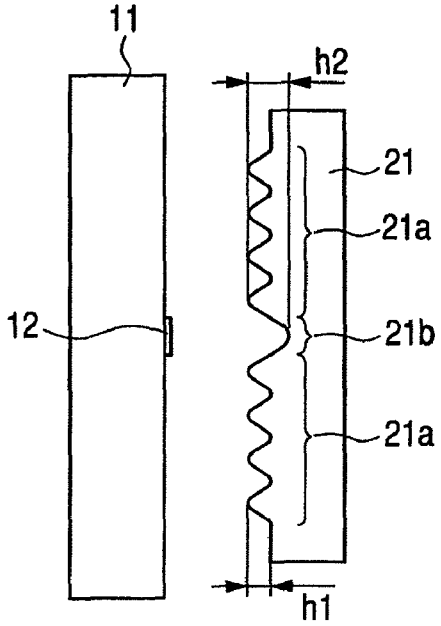
FIGS. 5A and 5B are cross-sectional schematic views illustrating a manufacturing process of the support member illustrated in FIG. 4.
Figure 5B:
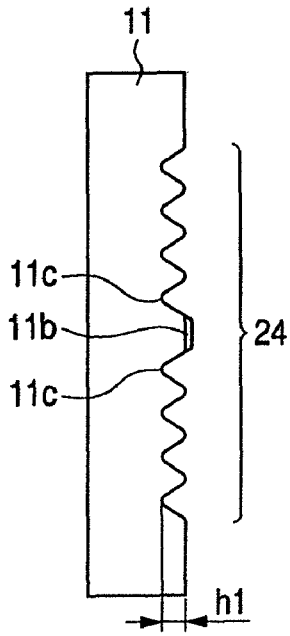

Similarly, also with regard to the concave portions 11*c*, one or more concave portions can be formed other than the concave portion adjacent to the electrode 11*b*. FIG. 4 illustrates an example of forming plural concave portions 11*c* on both sides of the electrode 11*b* which is put between the concave portions 11*c*. FIGS. 5A and 5B are schematic views illustrating a manufacturing process of the concave portions 11*c* and correspond to the cross-sectional surface A-A' in FIG. 4.

As the electron beam-irradiated member to be formed on the face plate 3, for example, a photoelectric conversion film other than the phosphor is used, and an image pickup electron beam displaying apparatus can be also constituted.

In addition, it is allowed that the electrode 11*b* is set to a floating condition without connecting to the power supply and the potential is determined by capacitive coupling depending on the potential applied to the rear plate 2 and the face plate 3, and it is also possible to perform a control by supplying the potential to the electrode 11 from an external.

In the latter case, a position of the electron beam can be controlled by the potential to be supplied to the electrode, and a degree of freedom in design is widened as the electron beam displaying apparatus.

Second Embodiment

In the present embodiment, a member obtained by forming the electrode 11*b* and the concave portions 11*c* on a surface of the base material 11*a* in the above-mentioned first embodiment is treated as a parent material, and the support member 11 can be more precisely formed by transforming the parent material into a shape similar to that of the parent material before drawn by executing a heat-drawing process in the longitudinal direction of the electrode 11*b*.

In a usual electron beam displaying apparatus, the size of a support member arranged between the rear plate 2 and the face plate 3 is that the height is several mm and the length in the X-direction, although it depends on the size of a panel, is about 1200 mm if the electron beam displaying apparatus is a large 60-inch-class screen. In case of long forming an electrode zone in the X-direction on a surface of the support member having a high aspect ratio like the above-mentioned apparatus by using a photolithography method, it is very difficult to ensure linearity of edge portions of the electrode due to the residual when performing an exposure and a development.

In the present embodiment, as described in the first embodiment, since the support member is drawn in the X-direction while heating the support member after forming the electrode 11*b* which is parallel in the X-direction and the concave portions 11*c* adjacent to the electrode 11*b*, the forming accuracy of the electrode 11*b* to be formed on a surface of the support member can be further improved.

Figure 6:
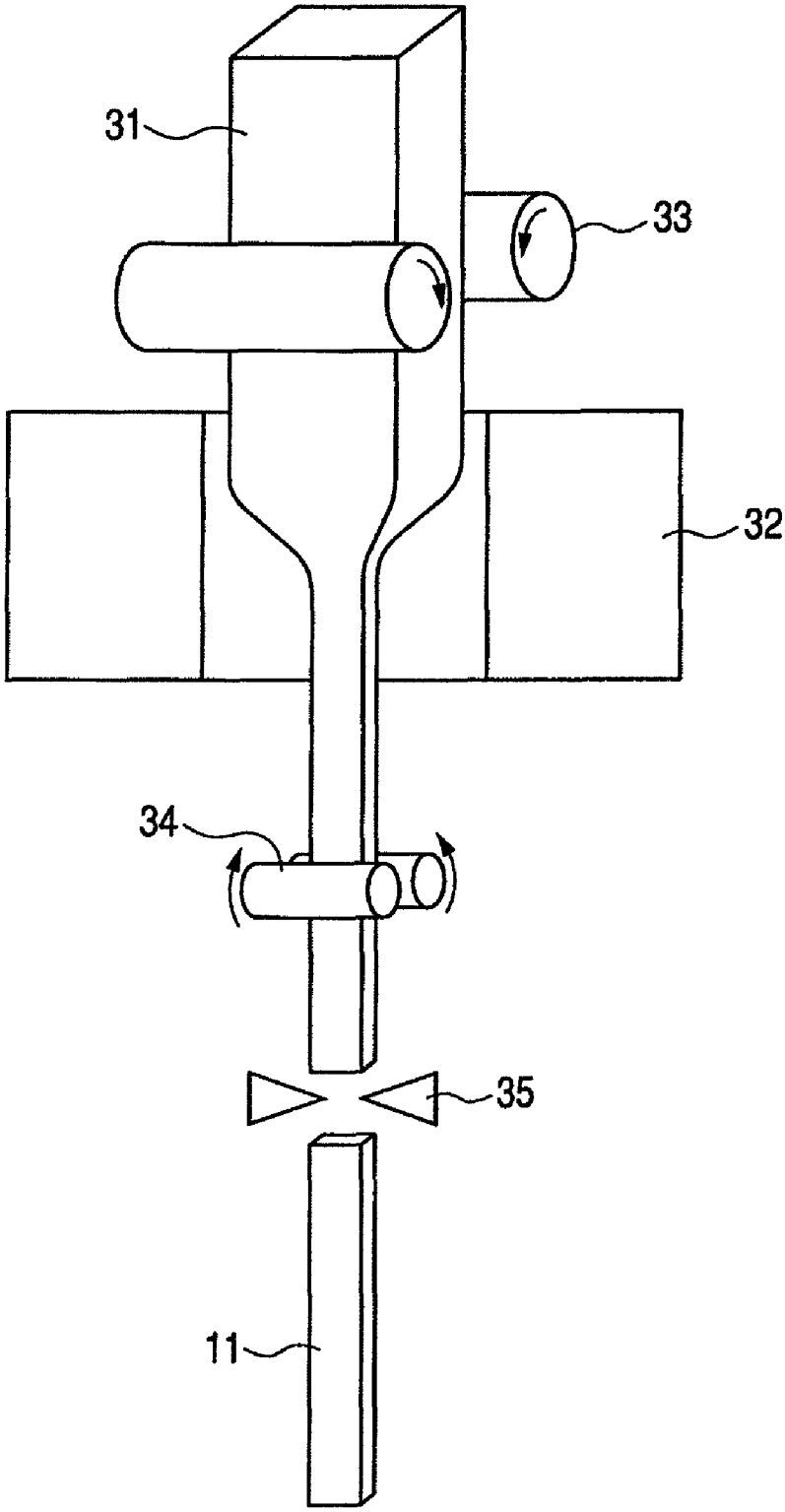
FIG. 6 is a schematic constitutional view of an example of a heat-drawing apparatus to be used in the present invention.

FIG. 6 is a schematic constitutional view of an apparatus which is used in a heat-drawing process. In FIG. 6, a parent material 31, a first push-out unit 33 and a heater 32 are illustrated. The parent material 31 obtained by forming the concave portions 11*c* and the electrode 11*b* on the base material 11*a* is descended by the fixed first push-out unit 33 at a constant speed and the parent material 31 is fed into the heater 32 and is heated by the heater 32. While executing this heating process, the parent material is drawn by pulling out at a speed higher than the above-mentioned pushing out speed by a second push-out unit 34 arranged at a lower position of the heater 32, and the support member 11 having a cross-sectional shape similar to a shape of the parent material 31 can be obtained. A cutoff unit 35 can use various manners such as a cutoff by a diamond cutter, a cutoff by abrasive grains and a cutoff by a laser.

According to the present embodiment, in case of forming the electrode 11*b* and the concave portions 11*c* on the base material 11*a*, these portions can be fabricated with a size several tens of times of a finished product. Generally, in a drawing process, since a shape is downsized as it is and formed, a fabricating error (a roll or the like on the edge of the electrode 11*b* when the concave portion 11*c* is fabricated by a grinding stone) at a condition before executing a drawing process is also downsized as it is, and the error itself also becomes a level of one-several tenths. Therefore, an error after executing the drawing process can be reached a level of one-several tenths as compared with a case of the first embodiment.

In the support member according to the first embodiment and the second embodiment, the base material 11*a* is in a state of exposing in a region other than the electrode 11*b*. In this case, in an insulator of which the base material is made from the substance such as a glass, doubts regarding the change of potential distribution on a surface of the support member by the electrostatic charge due to the collision of electrons when the electron beam displaying apparatus is operated and the electric discharge caused by a avalanche phenomenon of the electrification charge exist.

Therefore, it is also allowed to form the support member by coating an antistatic film on a surface of the support member 11 or using a technique such as a sputtering method. As a resistance value of this antistatic film, it is desirable that the resistance value is higher than that of the electrode 11*b* from a viewpoint of the potential definition, and further the high resistance can be also attained by the insulator. Because, the electrostatic charge itself when electrons were irradiated to the support member can be also decreased by adjusting a secondary electron emitting coefficient of the antistatic film. Therefore, the antistatic film has a function of decreasing the electrostatic charge on a surface of the support member and a function of stably forming the potential distribution in the Z-direction of the support member 11 together with the electrode 11*b* on a surface of the support member.

As materials of the antistatic film, metal oxides have an excellent property, and oxides of Cr, Ni and Cu are preferable materials among the metal oxides. Other than the metal oxides, a carbon, of which the secondary electron emitting efficiency is in a low level, is a preferable material. Especially, since an amorphous carbon is in a level of a high-resistance, the resistance of the support member 11 can be easily controlled to become a desirable value.

EXAMPLES

Example 1

The support member 11 illustrated in FIG. 1 was fabricated in accordance with the first embodiment. The support member 11 of the present example has a size that the height (Z-direction) is 4 mm, the width (Y-direction) is 0.5 mm and the length (X-direction) is 40 mm, and the concave portions 11*c* and the electrode 11*b* put between the two electrodes 11*c* are formed as illustrated in FIG. 2.

First, the tungsten (sheet resistance: $1\times10^5$ Ω/□) was previously formed on a part of the base material 11*a* composed of a PD200 produced by the ASAHI Glass Co., Ltd. as an electrode region 12 by a sputtering method with a thickness of 100 nm as illustrated in FIG. 3A. Next, a surface of the base material 11*a* is ground by using the grinding stone 21 having the convex portions 21*a* and the concave portion 21*b*, and the electrode 11*b* was formed by grinding the electrode region 12 at the same time of forming the concave portions 11*c*. The height of the convex portions 21*a* of the grinding stone 21 was set to become 20 μm and the depth of the concave portion 21*b* was set to become 30 μm. Herewith, the electrode 11*b* can be formed with a state of uniform position and width in a whole area of the X-direction.

Example 2

The support member 11 illustrated in FIG. 4 was fabricated in accordance with the second embodiment. As the base material 11*a*, a glass (PD200 produced by the ASAHI Glass Co., Ltd.) was processed to be formed into the form of a plate, of which the width is 50 mm, the length is 300 mm and the thickness is 6 mm, and then the concave portions 11*c* and the electrode 11*b* were formed. At this time, the sheet resistance was set to $1\times10^3$ Ω/□ since the resistance of the electrode 11*b* becomes a high level because the heat-drawing process is executed later. The convex portions 21*a* used for fabricating the concave portions 11*c* and the concave portion 21*b* having the depth h2 larger than the height h1 of the convex portions 21*a* are provided on the grinding stone 21 used for forming the concave portions 11*c* on the base material 11*a*. The height h1 of the convex portions 21*a* was set to become 0.3 mm and the depth h2 of the concave portion 21*b* was set to become 0.5 mm.

Next, the base material 11*a*, on which the above-mentioned concave portions 11*c* and the electrode 11*b* were formed, is heat drawn in the X-direction as the parent material 31 by a heat-drawing apparatus illustrated in FIG. 6 and the support member 11 was obtained. In FIG. 6, the parent material 31 is descended at a speed of 2.5 mm/min. by the fixed first push-out unit 33 and then the parent material 31 was heated to 790° C. by the heater 32. While executing this heating process, the parent material 31 is drawn by pulling out at a speed of 2700 mm/min. by the second push-out unit 34, and the support member 11 having a cross-sectional shape similar to a shape of the parent material 31 was obtained.

The obtained support member 11, of which the width is 1.6 mm and the thickness is 0.2 mm, was cut off by a laser of the cutoff unit 35 such that the length becomes 800 mm. The concave portions 11*c* of which the depth is 10 μm and the electrode 11*b* of which the width is 150 μm were formed on a main surface of an area 1.6 mm×800 mm of the obtained support member 11.

While the present invention has been described with reference to the exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2008-124555, filed May 12, 2008, which is hereby incorporated by reference herein in its entirety.

What is claimed is:

1. A method of manufacturing a support member to be used in an electron beam displaying apparatus in which an electron source for emitting electrons and an electron-irradiated member to which the electrons emitted from the electron source are irradiated are oppositely arranged via the support member, the method comprising:

forming, on a surface of a base material, an electrode region of which resistance is lower than that of the base material; and forming, with use of a grinding stone having a convex portion, a concave portion on the surface of the base material by grinding a portion on the surface of the base material where the electrode region has been formed, and an electrode by grinding a part of the electrode region.

2. A method of manufacturing the support member, according to claim 1, further comprising transforming the base material by heat-drawing, in a longitudinal direction of the electrode, the base material on which the concave portion and the electrode have been formed.

* * * * *